US005244031A

United States Patent [19]

Cook et al.

[11] Patent Number: 5,244,031

[45] Date of Patent: Sep. 14, 1993

[54] DUAL MODE GAS SYSTEM FOR CASTING

[75] Inventors: Arnold J. Cook, 372 No. Craig St., Pittsburgh, Pa. 15213; Paul S. Werner, Monroeville, Pa.

[73] Assignee: Arnold Cook, Pittsburgh, Pa.

[21] Appl. No.: 594,348

[22] Filed: Oct. 9, 1990

[51] Int. Cl.[5] ..... B22D 18/04

[52] U.S. Cl. ..... 164/119; 164/122; 164/306

[58] Field of Search ..... 164/65, 119, 253, 306, 164/122.1, 122

[56] References Cited

U.S. PATENT DOCUMENTS

| | | | |
|---|---|---|---|
| 3,690,367 | 9/1972 | Daniels | 164/122.1 |
| 3,727,674 | 4/1973 | Chatourel et al. | 164/119 |
| 3,761,218 | 9/1973 | Portalier | 164/119 |
| 4,252,173 | 2/1981 | Charbonnier | 164/119 |
| 4,889,177 | 12/1989 | Charbonnier et al. | 164/119 |

FOREIGN PATENT DOCUMENTS

| | | | |
|---|---|---|---|
| 2622213 | 10/1977 | Fed. Rep. of Germany | 164/122.1 |
| 1107958 | 8/1984 | U.S.S.R. | 164/119 |

*Primary Examiner*—Richard K. Seidel
*Attorney, Agent, or Firm*—Ansel M. Schwartz

[57] ABSTRACT

The present invention pertains to an apparatus for casting comprised of a pressure vessel and means for evacuating and pressurizing the vessel. The evacuating and pressurizing means is in fluidic connection with the vessel. The apparatus is also comprised of a crucible disposed in the pressure vessel within which material is melted. There is a mold disposed in the pressure vessel. Additionally, the apparatus is comprised of means for heating material in the crucible and the mold in the mold chamber such that material is melted in the crucible and stays melted as it is drawn up to the mold chamber while the evacuating and pressurizing means evacuates the vessel, and when it is forced into the mold while the evacuating and pressurizing means charges the vessel. The heating means is disposed in the vessel. The pressurizing means comprises at least one chill line which serves to chill the mold as the vessel is pressurized. The present invention also pertains to a method for casting. The method comprises the steps of placing in a mold chamber of a pressure vessel a mold; placing in a crucible of the pressure vessel a material; evacuating the vessel through the mold chamber; melting the material in the crucible; placing the crucible in fluidic connection with the mold chamber; and pressurizing the vessel at a controlled rate such that the pressurized gas flows through the chill line thereby serving the dual purpose of pressurizing the vessel and chilling the mold.

7 Claims, 4 Drawing Sheets

DUAL MODE GAS SYSTEM FOR CASTING

FIELD OF THE INVENTION

The present invention is related to an apparatus for casting metals. More specifically, the present invention is related to an apparatus and method for solidification of a metal casting within a pressure vessel.

BACKGROUND OF THE INVENTION

It is commonly known that directional solidification can enhance the structural properties of a cast metal part. Accordingly, it is desirable to cool a mold from one or several distinct locations.

It is known in the prior art to cast metal within a pressure vessel. This method consists essentially of disposing a mold and a source of molten metal, within a mold. The vessel is then pressurized in a manner which forces the molten metal into the mold. Since the entire process takes place within a pressure vessel, the pressure differential between the inside of the mold and the outside of the mold can be controlled, thus allowing the use of thin walled molds. It was known in the past to effect directional solidification by thermally contacting the mold with a cooled member such as a chill plate. However, there is no apparatus or method disclosed in the prior art which uses the gas pressurization means to chill or directionally solidify a metal casting within a pressure vessel.

SUMMARY OF THE INVENTION

The present invention pertains to an apparatus for casting. The apparatus is comprised of a pressure vessel and means for evacuating and pressurizing the vessel. The evacuating and pressurizing means is in fluidic connection with the vessel. The apparatus is also comprised of a crucible disposed in the pressure vessel within which material is melted. There is a mold disposed in the pressure vessel. Additionally, the apparatus is comprised of means for heating material in the crucible and the mold in the mold chamber such that material is melted in the crucible and stays melted as it is drawn up to the mold chamber while the evacuating and pressurizing means evacuates the vessel, and when it is forced into the mold while the evacuating and pressurizing means charges the vessel. The heating means is disposed in the vessel. The pressurizing means comprises at least one chill line which serves to chill the mold as the vessel is pressurized.

The present invention also pertains to a method for casting. The method comprises the steps of placing in a mold chamber of a pressure vessel a mold. Then, placing in a crucible of the pressure vessel a material. Next, evacuating the vessel through the mold chamber. Then, melting the material in the crucible. Next, placing the crucible in fluidic connection with the mold chamber; and pressurizing the vessel at a controlled rate such that the pressurized gas flows through the chill line thereby serving the dual purpose of pressurizing the vessel and chilling the mold.

BRIEF DESCRIPTION OF THE DRAWINGS

In the accompanying drawings, the preferred embodiments of the invention and preferred methods of practicing the invention are illustrated in which:

FIGS. 3*a*–3*d* are a cross-sectional schematic view of a method for casting.

DESCRIPTION OF THE PREFERRED EMBODIMENT

Figure 1:
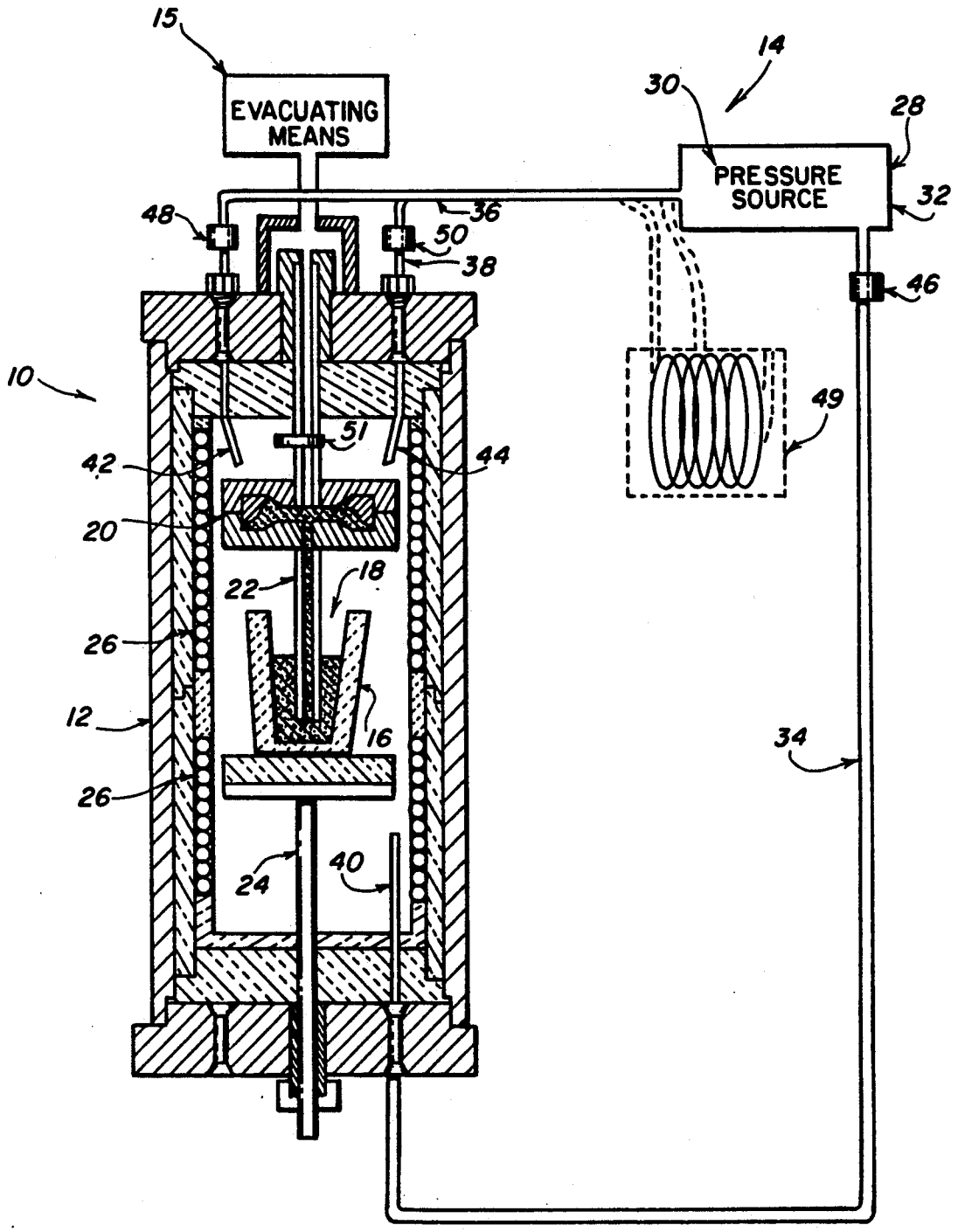
FIG. 1 is a cross-sectional schematic view of an apparatus for casting.

Referring now to the drawings wherein like reference numerals refer to similar or identical parts throughout the several views, and more specifically to FIG. 1 thereof, there is shown a cross sectional schematic of an apparatus 10 for casting and chilling. The apparatus 10 comprises a pressure vessel 12, means for pressurizing the vessel 14 and means for evacuating the vessel 15. The pressurizing means 14 is in fluidic connection with the vessel 12. Disposed within the vessel 12 is a crucible 16, containing a material 18, such as aluminum, and a mold 20. The mold 20 preferably includes a feeder tube 22 fluidically connected thereto and extending out therefrom. Preferably, the apparatus also comprises heating means 26 disposed within the pressure vessel 12 which allows melting of the metal 10 within the crucible 16. Preferably, the apparatus 10 includes a crucible lifter 24 disposed within the pressure vessel 12 for lifting the crucible 16, such that the molten metal 18 is placed in fluidic connection with feeder tube 22 and thus mold 20. See U.S. Pat. No. 5,111,871.

The means for pressurizing the vessel 14 comprises a pressure source 28 which is disposed outside of the pressure vessel 12 and preferably comprises pressurized gas 30 within a container 32. Fluidically connected to pressure source 28 are pressurization line 34 and chill lines 36 and 38 having their terminal ends 40, 42, 44 respectively within the pressure vessel 12. Terminal ends 40, 42, 44 are essentially open ended tubes.

Chill lines 36 and 38 preferably comprise means to position the terminal ends 42 and 44, respectively, at various locations in proximity to the mold 20. One such arrangement entails using stiff chill lines 36 and 38 that can slide in and out of the vessel 12 while maintaining a pressure seal, preferably with an o-ring. It should be noted that nozzles (not shown) can be disposed on terminal ends 40, 42, 44, thereby enhancing the flow of pressurized gas 30. Pressurization line 34 and chill lines 36 and 38 further comprise valves 46, 48, 50 respectively, which, depending on their state, fluidically connect or disconnect the pressure source 28 to the pressure vessel 12 through the respective lines 34, 36 or 38.

Evacuation means 15 is preferably fluidically connected to pressure vessel 12 through the mold 20 as shown in FIG. 1. It should be noted that the flow of molten metal from the mold 20 into the evacuation means 15 can be prevented by any preferable means such as a valve 51 or a water cooled head as in U.S. Pat. No. 5,111,871. Preferably, head chill lines 36 and 38 are fluidically connected to a refrigeration system 49 such that the cooling apparatus chills the pressurized gas 30 below the temperature at which it is stored within container 32.

Figure 2:
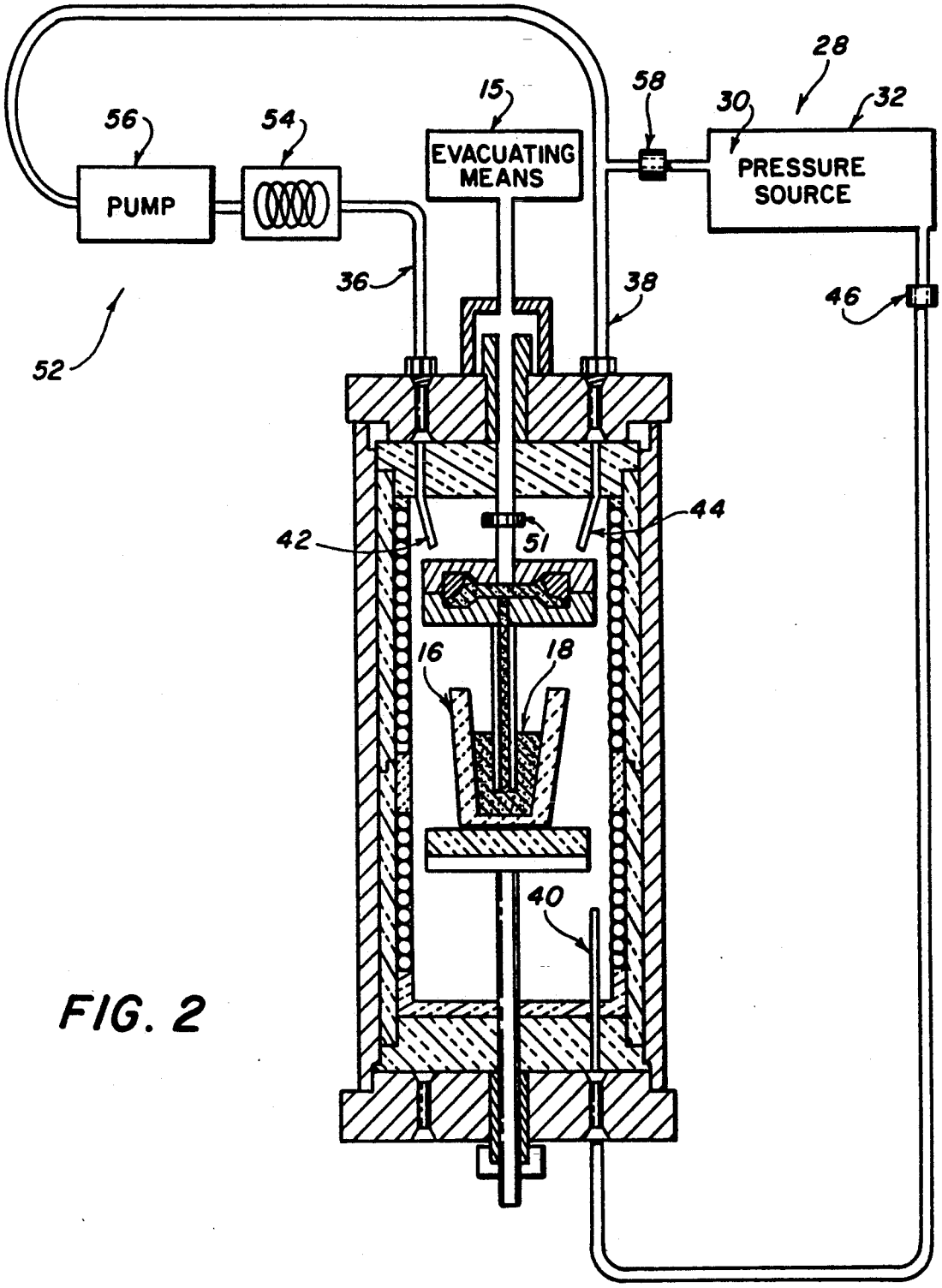
FIG. 2 is a cross-sectional schematic view of an apparatus for casting including a recirculation system.

As shown in FIG. 2, in an alternative embodiment, the pressure source 28 is comprised of a recirculation system 52 which includes means to chill the pressurized gas 30, such as a refrigeration system 54 and means to pump the pressurized gas in a circulatory manner such as a pump 56 wherein one chill line 36 acts as an intake thereby removing pressurized gas 30 from vessel 12 and the second chill line 38 acts as an exhaust thereby supplying chilled pressurized gas 30 to the vessel 12. Preferably, the recirculation system 52 includes a valve 58 thereby allowing the recirculation system 52 to be isolated from pressure source 28.

The present invention also pertains to a method for using the pressurized gas 30 from chill lines 36 and 38 to cool the melted material within mold 20. The method comprises the steps of placing a mold within a pressure vessel. Then, the step of placing a crucible containing material in the pressure vessel. Then, the step of evacuating the vessel. And then the step of melting the material 18 within crucible 16 by heating means 26 until it is molten. Next, the step of fluidically connecting the melted material 18 to the mold 20 by raising the crucible lifter 24 until the end of feeder tube 22 is disposed within the melted material 18.

Figure 3A:
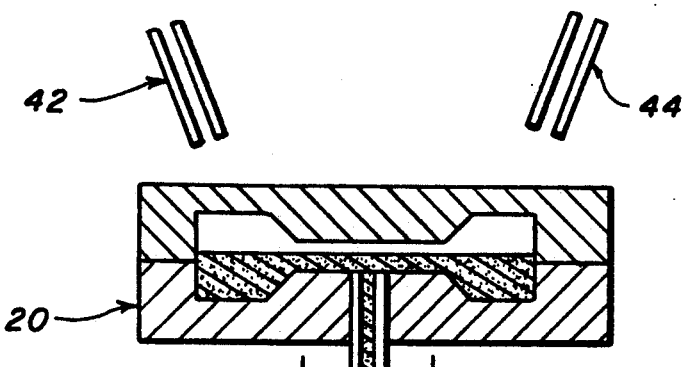
Figure 3B:
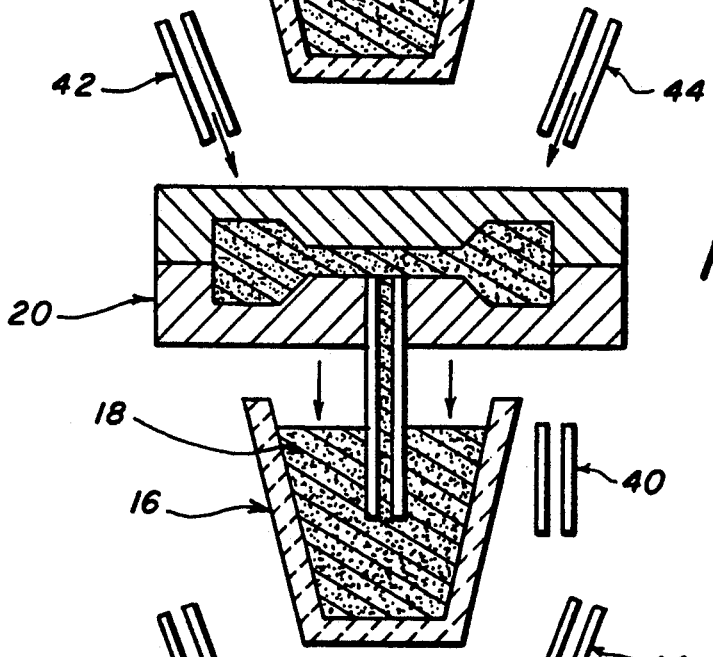
Figure 3C:
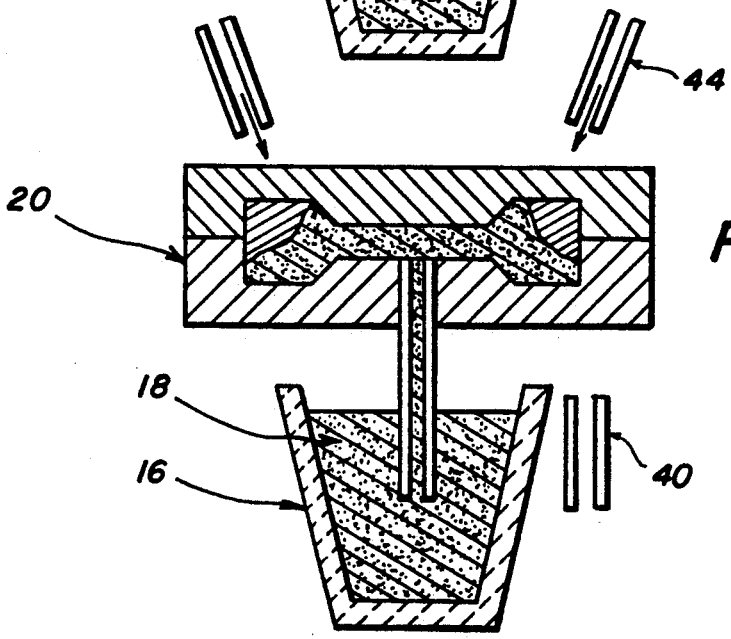

Then, in one preferred embodiment, opening valve 46 of pressurization line 34 thereby allows the pressurized gas 30 to flow through the terminal end 40 thereby pressurizing the pressure vessel 12. As shown in FIG. 3*a*, this pressurization action creates a force on the surface of melted material 18 thereby initiating the movement of melted material up into feeder tube 22 and mold 20. Then, there is the step of opening valves 48 and 50 thereby allowing pressurization gas 30 to flow through the terminal ends 42 and 44 of chill lines 36 and 38. As shown in FIG. 3*b*, this step increases the pressurization rate and thereby forces the metal 18 within the mold 20. As shown in FIG. 3*c*, the flow of pressurized gas 30 from terminal ends 42 and 44 simultaneously imparts a cooling effect on the mold 20 which cools the melted material 18 from the predetermined direction of the chill lines 36 and 38.

Figure 4A:
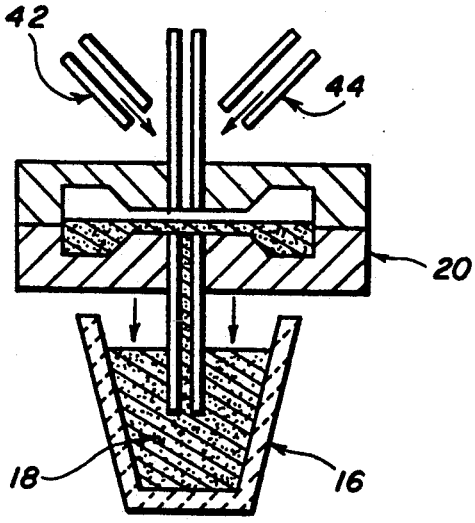
FIGS. 4*a*–4*d* are a cross-sectional schematic view of a second and third method for casting.
Figure 4B:
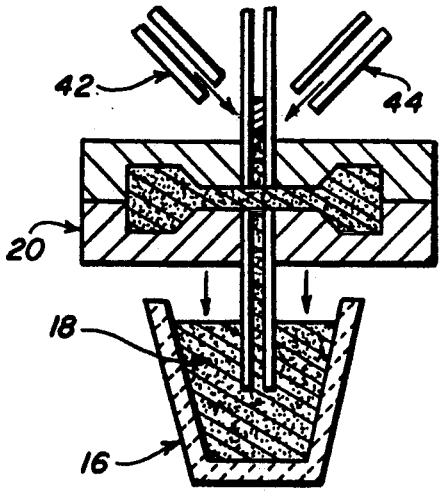

In another preferred embodiment, as shown in FIG. 4*a*, after the step of fluidically connecting the molten metal 18 to mold 20, there is the step of opening all three valves 46, 48 and 50 at the same time thereby allowing the pressurized gas 30 to pressurize the pressure vessel 12. This pressurization forces the melted material 18 within the mold 20 while simultaneously cooling the mold 20 as shown in FIG. 4*b*.

Figure 4C:
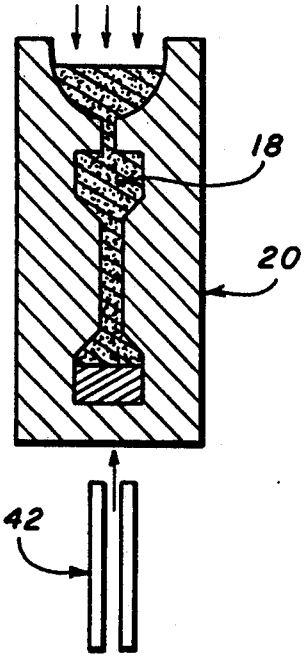
Figure 4D:
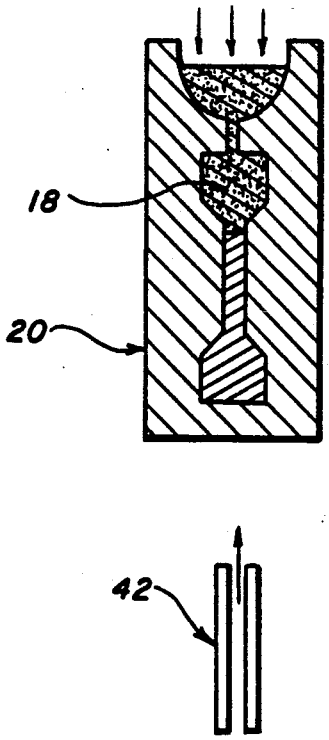

Referring to FIGS. 4*c* and 4*d* in another preferred embodiment, the terminal ends 42 and 44 comprise means to position them in a variety of different locations around mold 20 such that the terminal ends 42 and 44 can be moved around the mold 20 thereby altering the direction and intensity of chill as described above.

In another preferred embodiment, continuous cooling without increased pressurization can be achieved by including the step of closing valve 58 thereby fluidically isolating the pressure vessel 12 from pressure source 28. Followed by the step of circulating and refrigerating the pressurized gas 30 by the action of pump 56 and the refrigeration system 54, respectively.

The rate of cooling can be, for example, from 0.1° C./sec to 50° C./sec. For instance, in a plate mold where the pressurized liquid metal is introduced through the bottom of the mold, and a gas chill is directed at the top of the mold resulting in a 2° C./sec rate of cooling in the chamber, a 40° C. differential temperature is created between the top and bottom of the mold.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claims is:

1. A method for casting comprising the steps of:
placing a mold within a pressure vessel;
pressurizing the vessel with pressurized gas through a first chill line and a second chill line at a controlled rate such that the pressurized gas serves to pressurize the vessel and chill the mold;
isolating the first and second chill lines; and
circulating the pressurized gas such that one chill line acts as an intake and one chill line acts as an exhaust.

2. A method as described in claim 1 wherein before the circulating step, there is the step of chilling the pressurized gas with a refrigeration system.

3. A method as described in claim 2 wherein after the pressurizing step, there is the step of moving the chill lines in relationship to the mold thereby altering the direction and intensity of chill.

4. A method for casting comprising the steps of:
placing a mold within a pressure vessel;
pressurizing the vessel with pressurized gas at a first controlled rate such that the pressurized gas flows through a pressure line thereby initiating the movement of a melted metal in the pressure vessel in fluidic communication with the mold into the mold;
pressurizing the vessel with pressurized gas at a second controlled rate through a first chill line and a second chill line thereby serving the dual purpose of achieving the desired pressure with the pressure vessel and chilling the mold;
isolating the chill lines from the pressurizing means; and
circulating the pressurized gas with a pumping means wherein one chill line acts as an intake and one chill line acts as an exhaust.

5. A method as described in claim 4 including before the circulating step, the step of chilling the pressurized gas with a refrigeration system.

6. A method as described in claim 5 including after the step of pressurizing at a second controlled rate, the step of moving the chill lines in relationship to the mold thereby altering the direction and intensity of the chill.

7. An apparatus for casting comprising:
a pressure vessel with a mold therein;
means for pressurizing the pressure vessel, said pressurizing means fluidically connected to the pressure vessel and having first and second chill lines each of which have a terminal end disposed in proximity to the mold, said chill lines providing pressurized gas which serve the dual function of chilling the mold and pressurizing the vessel, said pressurization means includes a recirculation system which comprises means to pump the pressurized gas in a circulatory manner wherein one chill line acts as an intake and the other chill line acts as an exhaust.

* * * * *